US005400463A

United States Patent [19]

Attard et al.

[11] Patent Number: 5,400,463

[45] Date of Patent: Mar. 28, 1995

[54] NOISE DAMPENED CANISTER VACUUM CLEANER

[75] Inventors: Carmel P. Attard, Brampton; Byron Hacopian, Oakville; Muc Dang, Waterloo, all of Canada

[73] Assignee: Beam of Canada, Inc., Oakville, Canada

[21] Appl. No.: 17,528

[22] Filed: Feb. 16, 1993

[51] Int. Cl.[6] ..... A47L 5/38; A47L 9/00

[52] U.S. Cl. ..... 15/326; 15/314; 15/327.1; 15/413

[58] Field of Search ..... 15/326, 412, 413

[56] References Cited

U.S. PATENT DOCUMENTS 2,884,185 4/1959 Dolan ..... 15/326 X
4,330,899 5/1982 Miller et al. ..... 15/326
4,435,877 3/1984 Berfield ..... 15/326
4,665,581 5/1987 Oberdorfer ..... 15/326

*Primary Examiner*—Christopher K. Moore
*Attorney, Agent, or Firm*—Willian Brinks Hofer Gilson & Lione

[57] ABSTRACT

A canister vacuum cleaner improved by noise dampening means interposed between the outlets of its internal vacuum pump and the air outlet from the canister. The noise dampening means may comprise a baffle interposed between the pump outlets and air outlet of the canister in a manner which provides little resistance to a flow of air from the pump outlets to the air outlets of the canister. Further means which may comprise further baffles may be provided to dampen noise from the pump driving electric motor and motor cooling fan.

10 Claims, 7 Drawing Sheets

NOISE DAMPENED CANISTER VACUUM CLEANER

BACKGROUND OF THE INVENTION

1. Field of the Invention

This invention relates to a noise dampened canister vacuum cleaner.

2. Description of the Related Act

The typical central vacuum cleaner system for a home comprises a canister vacuum cleaner, known to those skilled in the art as the power unit, which creates a vacuum source, a fixed piping system which connects the power unit with outlets located in convenient locations throughout the house and portable flexible hosing which may be connected at one end to any of these outlets. The free end of the hosing is a remote source of the vacuum created by the power unit.

There are numerous advantages to the installation and use of a central vacuum system when a comparison is made to the use of a typical portable vacuum cleaner. These advantages result from, for example, the increased suction which may be created by a large, non-portable power unit, the elimination of the need to transport a vacuum power unit to the site requiring cleaning, the ease of maintenance and cleaning of central vacuum cleaning systems and the advantage of being able to exhaust dirty air (pre-filtered or not) to a remote location.

The power unit of a central vacuum system comprises the most complicated and costly component of the system. The main components of a typical power unit are a canister, an electric motor and an air pump driven by the motor, both located in the canister, a dirty air intake connected to the intake of the pump, an exhaust connected to the output of the pump and an air filter located between the dirty air intake and the pump. It is not necessary that the filtering means be included in the power unit itself. The power unit may simply deliver dirty air to a remote location where the dirty air may be filtered, or simply exhausted. In such systems, the pumping means should be adapted for pumping unfiltered air. Where the power unit includes a filtering means, it may comprise an air permeable diaphragm and filter bag used in combination. The diaphragm, typically made of cloth, provides support for the filter bag when in use. The bag is typically removable and disposable.

The air pump produces the vacuum which is required to draw dirty air into the canister, through the air filtering means and finally through the exhaust outlet. The air pump is usually a centrifugal fan.

The centrifugal fan typically consists of an impeller which rotates within a casing. The casing is usually cylindrical in shape; however, involute or shell-shaped casings are not unknown. The impeller usually consists of a number of blades mounted to a shaft to extend generally radially from the shaft, with the shaft projecting along the axis of the casing. In the case of a cylindrical casing, the casing may have an inlet end and a single exhaust port or several exhaust ports on its periphery. Typically, the air inlet to the casing is located near to the center of the impeller. The electric motor turns the pump shaft in order to rotate the impeller within the casing. The blades of the impeller, in revolving, produce a reduction in pressure near the center of the impeller. The air is thereby drawn through the air inlet, into the center of the impeller and is then forced outwardly along the impeller blades with an ever increasing tangential velocity. The velocity of the air as it leaves the outer portion of the blade tips is changed to a pressure head in its transfer to the casing, which in turn forces the air into the exhaust port or ports.

Increasing the speed of the rotation of the impeller results in a greater pressure head or an increased throughput of air through the impeller casing. This is a desirable characteristic in a vacuum cleaning system. An increase in impeller rotation is usually accomplished through the use of faster and more powerful electric motors to drive the impeller. Since central vacuum cleaners do not need to be designed for portability, they may be constructed with larger and therefore faster and more powerful motors to gain this desirable increase in suction. However, when operated at a faster speed, there is an increase in the noise level attributable in part to the air pump.

As noted above, the gain in speed of the air pump is usually accomplished through the use of a larger electric motor. Consequently, there is also an increase in the generation of noise level attributable to the electric motor.

The increase in the noise levels resulting from the larger electric motor and faster pump found in a central vacuum cleaner is an undesirable characteristic. Where the power unit of a central vacuum cleaner can be installed in a remote location, the high noise levels may be tolerable; however, where the installation of the power unit is made, for example, in the closet of a small apartment unit, an increase in noise level cannot be ignored.

It is an object of the present invention to provide a canister vacuum cleaner with means to dampen the noise attributable to the air pump.

Preferably the present invention provides means to dampen the noise attributable to the electric motor.

The use of any electric motor will result in a generation of heat. Such heat generation is the result of frictional losses in the motor in combination with heat generated by the conduction of electricity through the wire windings of the motor. This heat generation is more pronounced in larger and faster electric motors in comparison to their smaller counter parts.

It is known that the performance, and ultimately, the lifetime of an electric motor is generally inversely proportional to the ambient temperature in which it operates, if that ambient temperature is above the desired operating range of the motor. If an electric motor is often operated at a temperature higher than that for which it was designed, a breakdown of the materials which comprise the motor is to be expected as a direct result, and indirectly, through the breakdown of motor lubricants, expansion of moving parts to sizes outside their optimum tolerances, breakdown of insulative coatings, deformation of solid parts etc., a general deterioration of the motor is observed.

Preferably the noise dampening means of this invention for a canister vacuum cleaner is provided with a suitable manner for cooling the electric motor.

STATEMENT OF THE INVENTION

According to an aspect of the present invention, there is provided a noise dampening apparatus for use in a canister vacuum cleaner of the type having a canister with two closed ends; an air inlet and an air outlet in said canister; a first barrier in said canister between said air inlet and said air outlet, said first barrier having an aperture therethrough, said first barrier defining a sealed first air pathway between a first of said two closed ends of said canister and said first barrier, said first air pathway incorporating said air inlet and said aperture; a cooling air inlet and a cooling air outlet in said canister; an air pump assembly in said canister, said air pump assembly having an air pump and an electric motor, said air pump having a pump inlet and a pump outlet, said air pump assembly mounted to said first barrier with said pump inlet sealed about said aperture and adapted, when driven by said electric motor, to pump air therethrough to said pump outlet, said electric motor having a motor cooling air inlet, a motor cooling air outlet and a fan, said fan drawing air from said motor cooling air inlet to said motor cooling air outlet when said electric motor is actuated; said noise dampening apparatus comprising, in order of stacked arrangement within said canister vacuum cleaner, a first component, a second component and a cooling air inlet baffle, each of said first and second components being identical and each comprising, (i) a barrier portion, said barrier portion having a first side and a second side; (ii) a first baffle extending generally perpendicularly from said first side of said barrier portion; (iii) a second baffle extending generally perpendicularly from said second side of said barrier portion; and (iv) spacer means on said first side of said barrier portion, said barrier portion of said first component forming a second barrier sealingly engaging said canister between said air outlet and said cooling air outlet and sealingly engaging said pump assembly between said pump outlet and said motor cooling air outlet, thereby defining a sealed second air pathway between said first barrier and said second barrier, said second air pathway incorporating said pump outlet and said air outlet; said barrier portion of said second component forming a third barrier sealingly engaging said canister between said cooling air inlet and said cooling air outlet and sealingly engaging said pump assembly between said motor cooling air inlet and said motor cooling air outlet, thereby defining a sealed third air pathway between said second barrier and said third barrier, said third air pathway incorporating said motor cooling air outlet and said cooling air outlet, said third barrier also thereby defining a sealed fourth air pathway between said third barrier and said other of said two closed ends of said canister, said fourth air pathway incorporating said cooling air inlet and said motor cooling air inlet; said spacer means of said second component for positioning said cooling air inlet baffle between said motor cooling air inlet and said cooling air inlet, said first baffle of said second component and said cooling air inlet baffle providing, in combination, no line of sight between said motor cooling air inlet and said cooling air inlet; said spacer means of said first component for positioning said first component in stacked relationship with said second component; said second baffle of said second component and said first baffle of said first component, in combination, providing no line of sight between said motor cooling air outlet and said cooling air outlet without blocking said third sealed air pathway; and said second baffle of said first component sealingly engaging said first barrier and providing no line of sight between said pump outlet and said air outlet without blocking said second sealed air pathway.

According to another aspect of the present invention, there is provided a noise dampening apparatus for use in a canister vacuum cleaner of the type having a vertically oriented, cylindrical canister with two closed ends; an air inlet and an air outlet in said canister; a first horizontal barrier in said canister between said air inlet and said air outlet, said first horizontal barrier having an aperture therethrough, said first horizontal barrier defining a sealed first air pathway between a first of said two closed ends of said canister and said first horizontal barrier, said first air pathway incorporating said air inlet and said aperture; a cooling air inlet and a cooling air outlet in said canister; an air pump assembly in said canister, said air pump assembly having an air pump and an electric motor, said air pump having a pump inlet and a pump outlet, said air pump assembly mounted to said first horizontal barrier with said pump inlet sealed about said aperture and adapted, when driven by said electric motor, to pump air therethrough to said pump outlet, said electric motor having a motor cooling air inlet, a motor cooling air outlet and a fan, said fan drawing air from said motor cooling air inlet to said motor cooling air outlet when said electric motor is actuated; said noise dampening apparatus comprising, in order of stacked arrangement within said canister vacuum cleaner, a first component, a second component and a cooling air inlet baffle, each of said first and second components being identical and each comprising: (i) a horizontal barrier, said horizontal barrier having a lower side and an upper side; (ii) a downwardly depending baffle depending generally perpendicularly from said lower side of said horizontal barrier; (iii) an upstanding baffle extending generally perpendicularly from said upper side of said horizontal barrier; and (iv) spacer means on said lower side of said horizontal barrier, said horizontal barrier of said first component forming a second horizontal barrier sealingly engaging said canister between said air outlet and said cooling air outlet and sealingly engaging said pump assembly between said pump outlet and said motor cooling air outlet, thereby defining a sealed second air pathway between said first horizontal barrier and said second horizontal barrier, said second air pathway incorporating said pump outlet and said air outlet; said horizontal barrier portion of said second component forming a third horizontal barrier sealingly engaging said canister between said cooling air inlet and said cooling air outlet and sealingly engaging said pump assembly between said motor cooling air inlet and said motor cooling air outlet, thereby defining a sealed third air pathway between said second horizontal barrier and said third horizontal barrier, said third air pathway incorporating said motor cooling air outlet and said cooling air outlet, said third horizontal barrier also thereby defining a sealed fourth air pathway between said third horizontal barrier and said other of said two closed ends of said canister, said fourth air pathway incorporating said cooling air inlet and said motor cooling air inlet; said spacer means of said second component for positioning said cooling air inlet baffle between said motor cooling air inlet and said cooling air inlet, said downwardly depending baffle of said second component and said cooling air inlet baffle providing, in combination, no line of sight between said motor cooling air inlet and said cooling air inlet; said spacer means of said first component for positioning said first component in stacked relationship with said second component; said upstanding baffle of said second component and said downwardly depending baffle of said first component, in combination, providing no line of sight between said motor cooling air outlet and said cooling air outlet without blocking said third sealed air pathway; and said upstanding baffle of said first component sealingly engaging said first horizontal barrier and providing no line of sight between said pump outlet and said air outlet without blocking said second sealed air pathway.

BRIEF DESCRIPTION OF THE DRAWINGS

The invention will be more clearly understood after reference to the following detailed specification read in conjunction with the drawings which disclose example embodiments of the invent ion wherein:

With reference to FIGS. 1 and 2 of the drawings, reference numeral 10 refers generally to a canister vacuum cleaner which includes a canister wall 12, sealed at one end by a top plate 14 and covered at the other end by a bottom plate 16. Both top and bottom plates, 14 and 16, form an air tight seal about the periphery of canister wall 12. Canister wall 12 is typically cylindrical in shape. Canister wall 12 may include wall mounting brackets 18.

Figure 1:
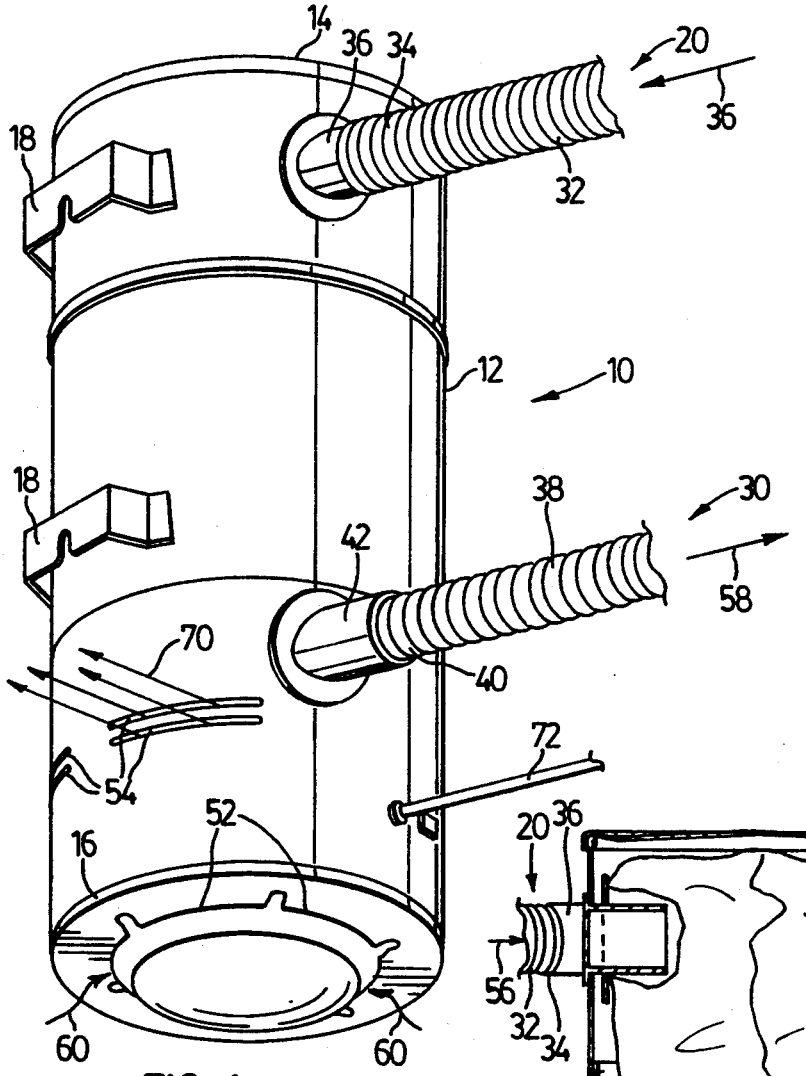
FIG. 1 is a pictorial view of a canister vacuum cleaner constructed in accordance with an embodiment of the present invent ion.

Reference numeral 20 refers generally to an air inlet and reference numeral 30 refers generally to an air outlet. Air inlet 20 includes a vacuum cleaner hose 32 which at its distal end (not shown) may be connected to vacuum cleaner tools used by an operator to clean at a remote location. Vacuum cleaner hose 32 is connected at its proximate end 34 to an air inlet adaptor 36 which is located through canister wall 12 near top plate 14. Vacuum cleaner hose 32 may be connected at its proximate end 34, in an alternate embodiment, to one end of a length of tubing (not shown), the tubing then connected at its other end to air inlet adaptor 36.

Air outlet 30 comprises exhaust hosing 38 which at its distal end (not shown) is located somewhere suitable for exhausting of vacuuming air, which may be filtered or unfiltered. The proximate end 40 of exhaust hosing 38 is connected to air outlet adaptor 42 which is located through canister wall 12 adjacent air pumping means 50 mounted within canister vacuum cleaner 10. In an alternate embodiment, exhaust hosing 38 may be connected at its proximate end 40 to one end of a length of tubing (not shown), the tubing then connected at its other end to air outlet adaptor 42.

Bottom plate 16 may include canister cooling air inlets 52 located therethrough. Further, canister wall 12 may include canister cooling air outlets 54 located therethrough.

In operation, the illustrated embodiment establishes two independent air circulation streams. The first is the dirty air filtering circulation required for vacuum cleaning. The second is a circulation of cooling air required .to cool the electric motor. When air pump 50 is activated, dirty air is drawn into air inlet 20 in the direction shown by arrow 56. The dirty air is expelled through air outlet 30 in the direction of arrow 58. The dirty air may or may not be filtered within the canister vacuum cleaner. This is discussed further below.

Simultaneously with the vacuuming circulation of air, cooling air circulation means (shown in a later Figure), draws air through the electric motor (shown in a later Figure). The cooling air circulation means draws cooling air from the atmosphere through canister cooling air inlets 52 in the direction of arrow 60. In an alternate embodiment, the cooling air circulation means draws cooling air from the air circulating in the vacuuming air stream. The cooling air circulation means exhausts cooling air from the electric motor then through canister cooling air outlets 54 in the direction of arrows 70. The motor cooling air circulation is discussed further below.

The pump driving electric motor (not shown) is powered by a remote electrical power supply to which vacuum cleaner 10 is connected through shielded electrical outlet cable 72.

Figure 2:
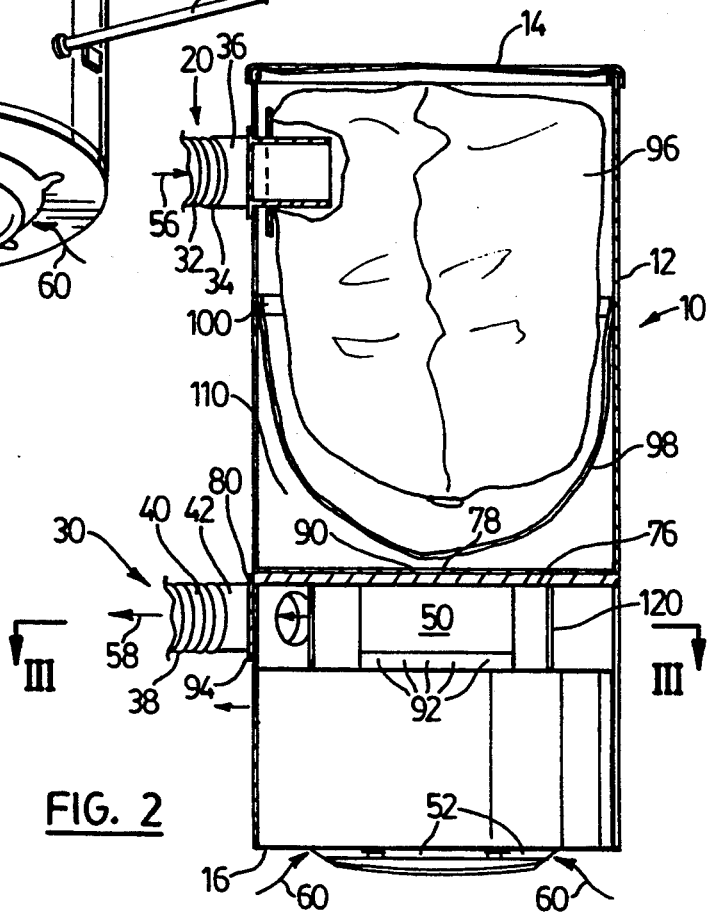
FIG. 2 is a side elevational view, broken away, of the vacuum cleaner of FIG. 1, showing the relative positioning of the filter bag and cloth diaphragm within the canister with respect to the air inlet and air outlet, as well as a partial cross-sectional side view of the pump discharge area.

The manner in which dirty air is circulated within the vacuum cleaner is best understood with reference to FIG. 2. A first air impervious barrier 76, with a central aperture 78 extends across the canister from canister wall 12 near one side 80 of air outlet adapter 42. Air pump 50 is centrally mounted within the canister to the first air impervious barrier 76 such that the pump inlet 90 is registered with aperture 78 of barrier 76. Thus barrier 76 separates pump inlet 90 and pump outlets 92.

When air pump 50 is activated, the dirty air drawn in the direction of arrow 56 through inlet adaptor 36 passes through filter bag 96, through cloth diaphragm 98 to air pump inlet 90. The air is drawn through the pump and is expelled through pump outlets 92 and ultimately through air outlet adaptor 42. Foreign matter carried with the dirty air drawn in the direction of arrow 56 will be separated from the air stream by filter bag 96. Once full, filter bag 96 may then be disposed of and replaced with another filter bag. Cloth diaphragm 98 provides extra support for filter bag 96 while in use. Cloth diaphragm 98 may be held in place within canister 12 by retaining ring 100.

As indicated above, embodiments of the invention may be contemplated which do not provide filtering means within the canister, but simply act as a dirty air pumping station, moving dirty air from one location to another.

The air flow path between inlet adaptor 36 and pump inlet 90 is herein referred to as a first isolated air flow path 110. First isolated air flow path 110 is bounded by canister wall 12, first barrier 76, and top plate 14. The air flow path is isolated in the sense that there are no air inlets to the air flow path 110 other than from inlet adapter 36 and no air outlets from the air flow path 110 other than to pump inlet 90.

Figure 3A:
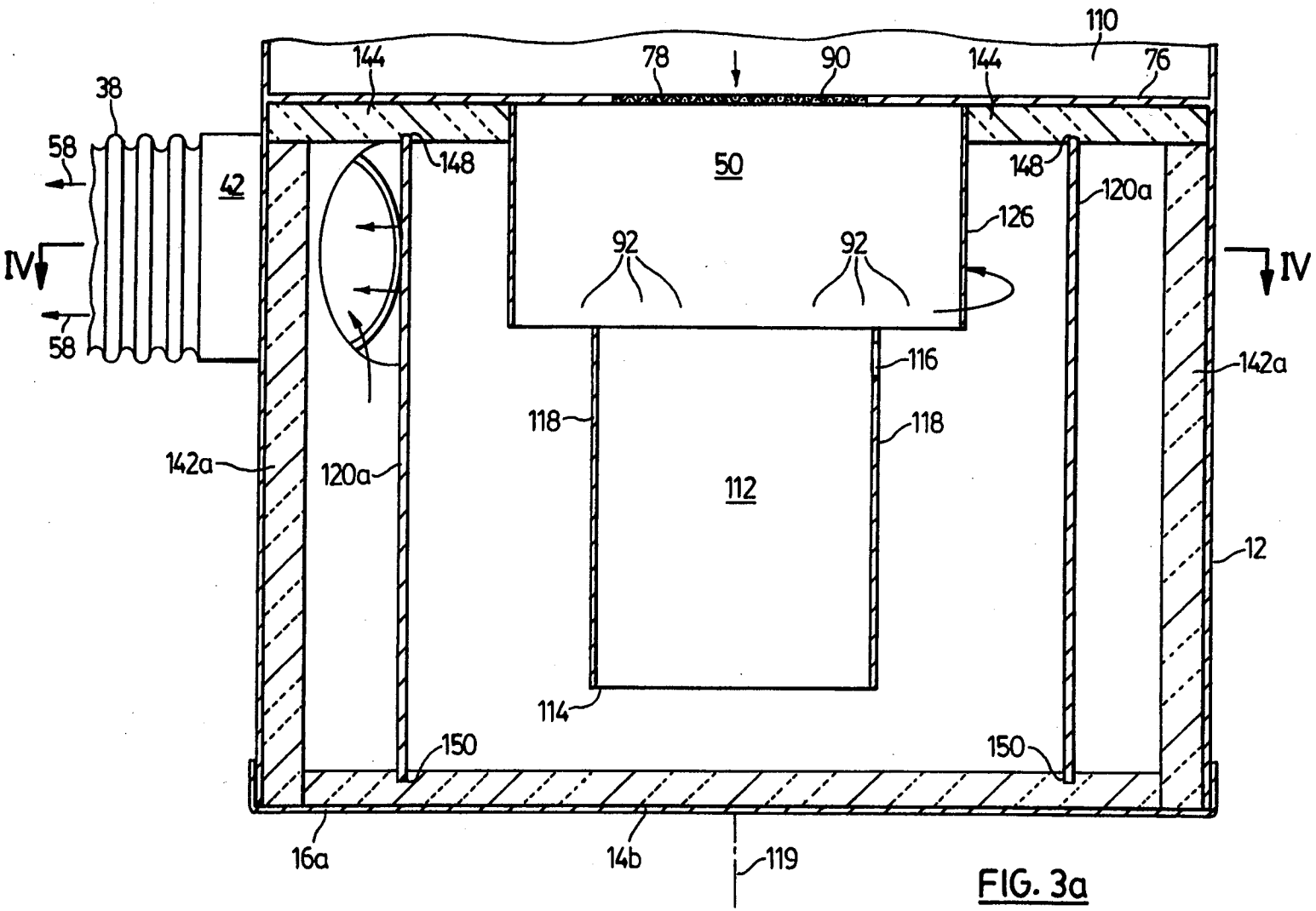
FIGS. 3*a*, 3*b* and 3*c* are elevational cross-sections along the lines III—III of FIG. 2 of three embodiments of the bottom portion of the canister vacuum cleaner.
Figure 3B:
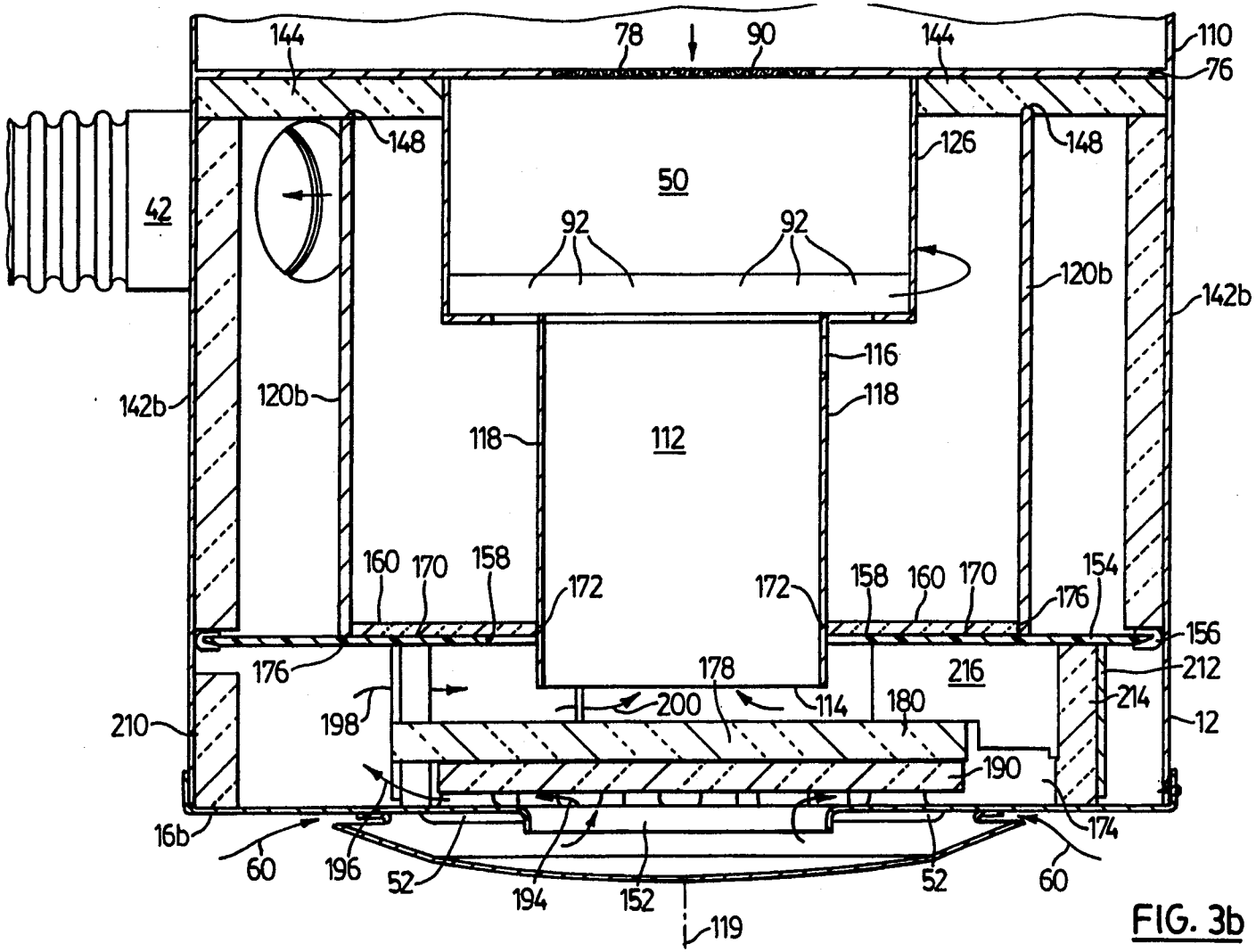
Figure 3C:
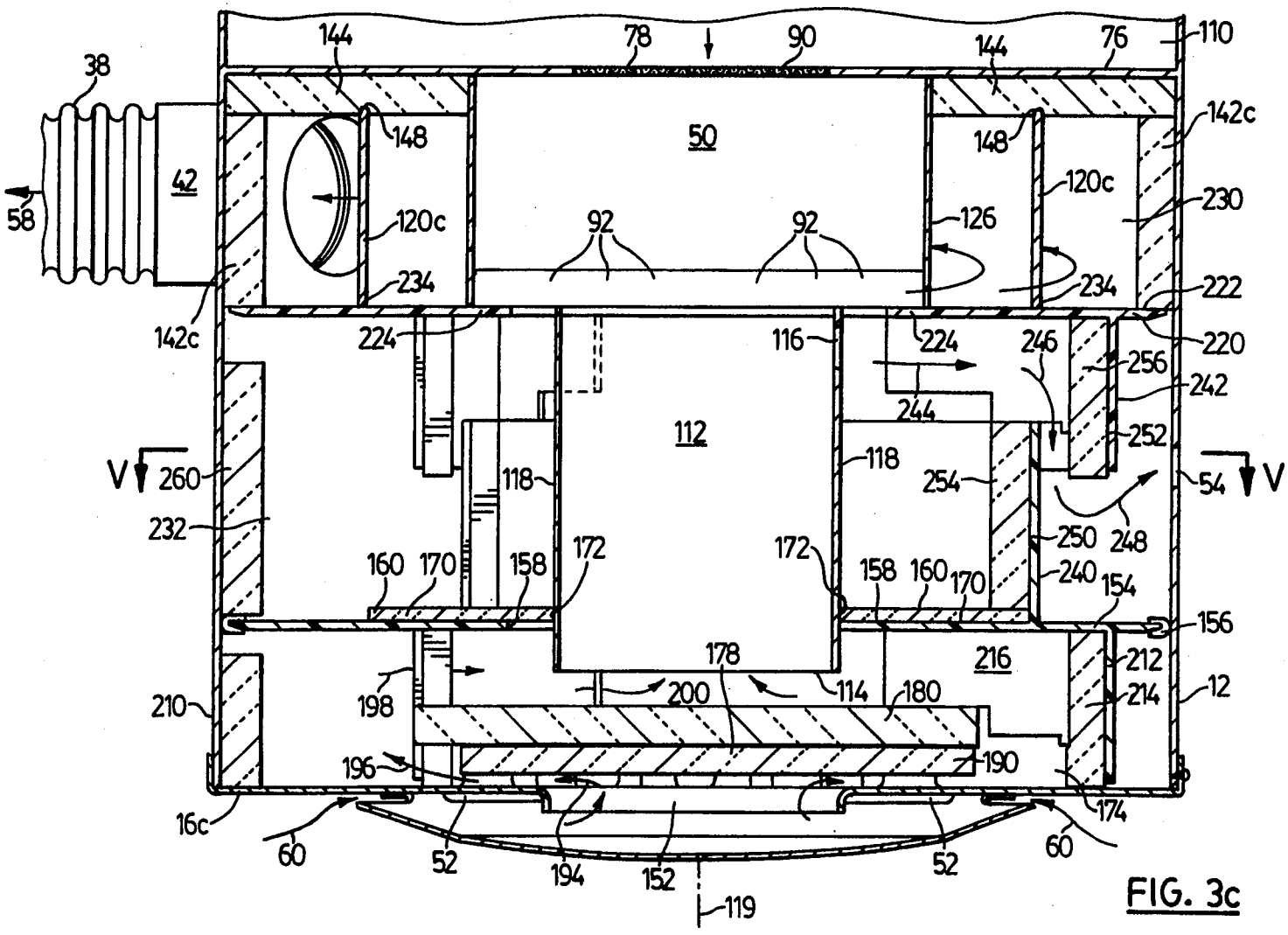

FIGS. 3*a*, 3*b* and 3*c* illustrate three lower end cross-sectional views of alternative embodiments of the invention; FIG. 3*a* shows an embodiment having no canister cooling air inlets or outlets; FIG. 3*b* shows an embodiment with no canister cooling air outlets; and FIG. 3c shows an embodiment including cooling air inlets and outlets in the canister wall.

In the embodiments of each of FIGS. 3a, 3b and 3c, the canister vacuum cleaner contains an electric motor 112 having motor cooling air inlets 114 and motor cooling air outlets 116 located through motor housing 118. Electric motor 112 is operably connected to the impeller (shown in a later figure) of air pump 50, the impeller having an axis of rotation 119. Motor 112 is mounted to air pump 50. Air outlet adapter 42 is located through canister wall 12 in longitudinal alignment with pump outlets 92 of air pump 50.

Referring specifically to FIG. 3a, pump discharge baffle 120a is interposed between pump outlets 92 and air outlet adapter 42 so as to block any line of sight (i.e. straight line path) from the pump outlets 92 to the air outlet adapter 42. in part, because baffle 120a is spaced from outlets 92 and outlet adapter 42, it provides little resistance to the flow of air from pump outlets 92 t o outlet adapter 42.

Figure 4:
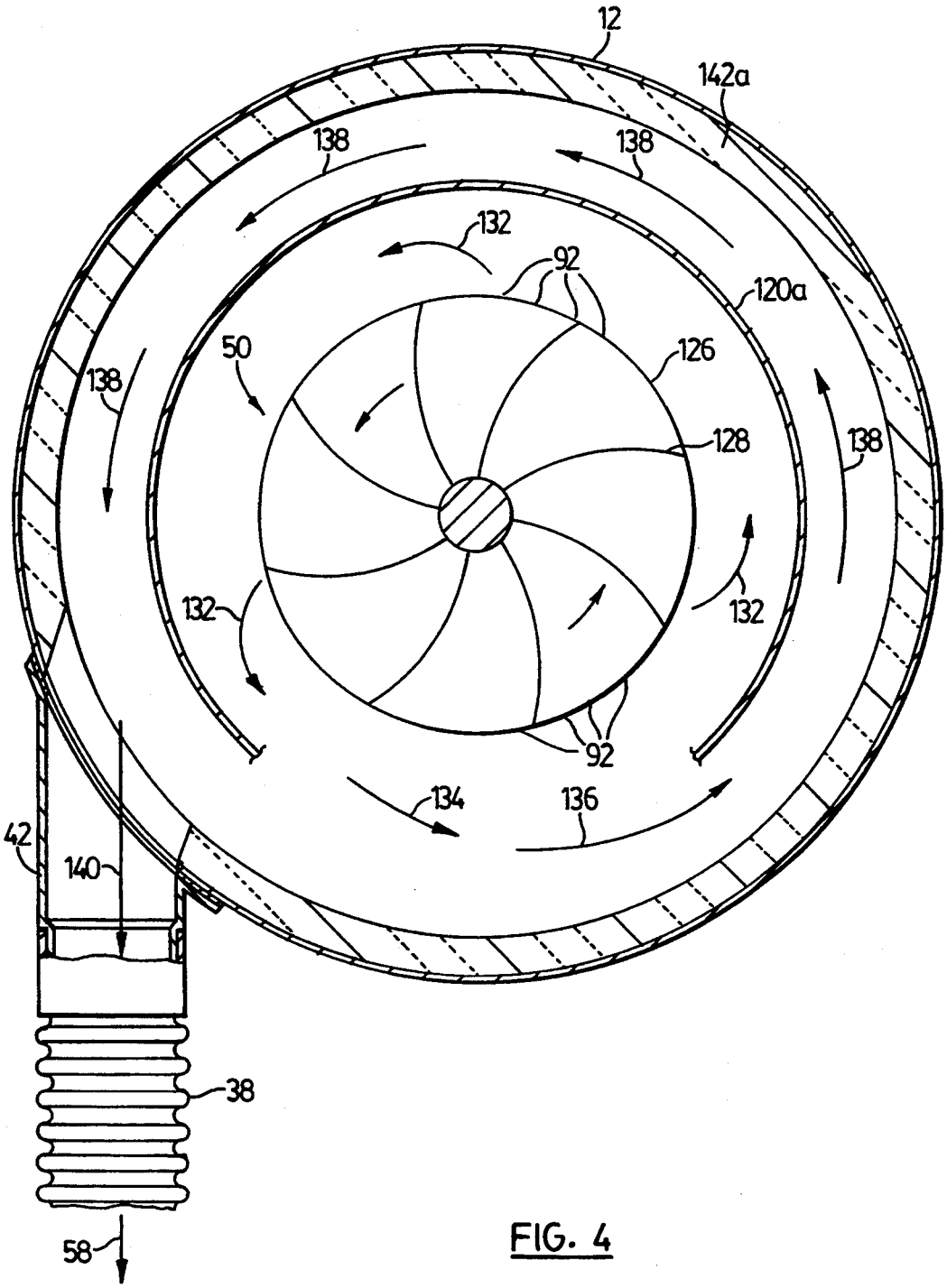
FIG. 4 is a cross-sectional plan view along the lines IV—IV of FIGS. 3*a*, showing the pump discharge air circulation within a second isolated air flow path of an embodiment of the present invention.

Referring to FIG. 4 which is a cross-sectional view along the line III—III of FIG. 3a, air pump 50 is centrally located within canister wall 12. Pump outlets 92 are located through pump casing 126. The air pump 50 is a tangential discharge air pump in which casing 126 is generally circular in cross-section. An air impeller 128 is rotated within the casing 126 for drawing air from pump inlet 90 which is located through an end of the casing 126 near to the axis of rotation of the impeller 119 (shown in FIGS. 3a, 3b and 3c) and forcing the air from the casing 126 through pump outlets 92. Pump outlets 92 are oriented to direct air from casing 126 in a generally tangential direction indicated by arrows 132. Pump discharge baffle 120a forms a partial arc about casing 126. Pump discharge baffle 120a is thus oriented so that noise generated by air pump 50 cannot travel directly to air outlet adapter 42. Additionally, the arcuate nature of discharge baffle 120a presents a minimal disruption to the flow of air from pump outlets 92. As indicated by direction arrows 134, 136 and 138, all air discharged from pumping means 50 through pump outlets 92 completes a partial circumferential route about the interior of the canister before being exhausted in the direction of arrow 140 through air outlet adapter 42. This placement of a pump discharge baffle 120a results in a marked decrease in ambient operating noise levels created by air pump 50.

To further dampen noise emanating from air pump 50, noise absorbing material 142a may be attached as a lining to the inner face of canister wall 12.

Referring solely to FIG. 3a, pump discharge baffle 120a extends between first barrier 76, to which is attached further noise absorbing material 144, and canister end plate 16a which is lined with noise absorbing material 146. Thus pump discharge baffle does not seal directly with barrier 76 or bottom plate 16a but sealingly engages noise absorbing material 144 and 146 along edges 148 and 150, respectively.

Baffle 120a need only extend from barrier 76 a distance necessary to block any line of sight from pump outlets 92 to air outlet adapter 42. However, the further extension of baffle 120a blocks any line of sight from motor cooling air outlets 116 to air outlet adapter 42 to further reduce ambient operating noise levels.

In use, the air required to cool motor 112 is drawn from motor cooling air inlets 114 by a motor fan (shown in a later figure) contained within motor housing 118. The fan therefore acts as a cooling air circulation means. Air, having passed through motor 112, is exhausted through motor cooling air outlets 116. As a result, the whirlwind of air from air pump 50 described above mixes with the air exhausted from motor cooling outlet 116 resulting in a combination of exhausted motor cooling air and pumped dirty air being exhausted through air outlet 42.

Another embodiment of the invention is shown in FIG. 3b. In this further embodiment wherein like parts have been given like reference numerals, there is a bottom plate cooling air aperture 152 which extends through bottom plate 16b. Also, annular air impervious barrier 154 extends across the canister and, by reason of seal 156, seals against canister wall 12. The annulus of the barrier 154 receives motor housing 118. The barrier 154 is sealingly engaged with motor housing 118 by donut-shaped sealing adapter 160 which is adhered to the surface 170 of the barrier 154. The edge 172 of the adapter 160 sealingly engages motor housing 118 at a point which between motor cooling air inlet 114 and motor cooling air outlet 116. Thus the barrier with its seal 156 and sealing adapter 160 is air impervious. This configuration provides a further isolated air flow path 174 from canister cooling air inlets 52 through bottom plate cooling air aperture 152 to motor cooling inlets 114. The further isolated air flow path 174 is bounded by canister wall 12, canister bottom plate 16b and further barrier 154. The further air flow path 174 is isolated in the sense that there are no air inlets to the further air flow path 174 other than from bottom plate cooling air aperture 152 and no air outlets from the air flow path 174 other than to motor cooling air inlets 114.

In FIG. 3b, pump discharge baffle 120b extends from further barrier 154 along edge 176, to a sealing relationship along edge 148 with noise absorbing material 144 adhered to first barrier 76. The pump discharge baffle 120b blocks noise emanating from motor cooling air outlets 116 as well as from air pump 50, to air outlet adapter 42, by blocking any line of sight therebetween. It should be understood that a baffle 120b which only blocks noise emanating directly from air pump 50 to air outlet adapter 42 is an alternate, though somewhat inferior, embodiment of the invention.

In use, the air required to cool motor 112 is drawn through further air flow path 174 ensuring a fresh supply of cooling air. As in the embodiment of FIG. 3a, air, having passed through motor 112, is exhausted through motor cooling air outlets 116 and the result is that a combination of cooling air and dirty air is exhausted though air outlet 42.

Inlet baffle 178 between motor cooling air inlets 114 and bottom plate cooling air aperture 152 is provided to reduce the noise emanating from within canister vacuum cleaner 10 most notably from motor 112. Cooling air inlet baffle 178 is constructed from two disk-shaped layers of a noise absorbing material, 180 and 190, and is preferably relatively air impermeable. Cooling air inlet baffle 178 causes air drawn through further air flow path 174 to follow the tortuous path shown by arrows 194, 196, 198 and 200. The tortuous air flow path does not present any significant resistance to the flow of cooling air to motor cooling inlets 114. However, there is an elimination of any line of sight for the travel of noise waves from electric motor 112 directly to bottom plate cooling air aperture 152. Additionally, the noise wave energy is significantly absorbed by the inlet baffle 178.

Additional noise absorbing material 210 is to the inside of canister wall 12 to provide additional absorption of noise within further air flow path 174.

An arcuate barrier 212 partially surrounding motor cooling air inlets 114. Noise absorbing material 214 is adhered to that barrier 212 to further reduce noise emanating from the canister vacuum cleaner 10.

As will be noticed in the description of FIG. 3*c* below, the provision of barrier 212 is simply a result of manufacturing detail. In an embodiment without barrier 212, noise absorbing material may be adhered to the inner surface of canister wall 12 to further reduce noise emanating from the canister vacuum cleaner.

Several supports 216 extend from barrier 154 toward bottom plate **16*b*, to provide a support for inlet baffle 178 so that the inlet baffle is spaced from motor cooling air inlets 114**.

Another embodiment of the invention is shown in FIG. 3*c*. In this further embodiment wherein like parts have been given like reference numbers, there are further provided canister cooling air outlets 54 extending through canister wall 12. Also, another substantially airtight barrier 220 in addition to a further substantially airtight barrier 154 (as provided in the embodiment of FIG. 3*b*) is provided. Barrier 220 will be hereinafter referred to as second barrier 220 and barrier 154 will be referred to as third barrier 154. Second barrier 220 is an annular disk extending from a sealing relationship with canister wall 12 to overlap with the bottom surface of 224 of air pump 50 in order to separate the motor cooling air outlets 116 from the pump outlets 92.

In FIG. 3*c*, second barrier 220 is shown to seal along the edge 222 of noise absorbing material 142 adhered to the inner surface of canister wall 12. The second barrier 220 is attached to pump casing 126. This configuration provides second and third isolated air flow paths 230 and 232 respectively. Second isolated air flow path 230 extends from pump outlets 92 to air outlet adapter 42. There are no further air inputs to or outlets from this second air flow path 230. Second air flow path 230 is bounded by canister wall 12, pump casing 126, first barrier 76 and second barrier 220. Third isolated air flow path 232 extends from motor cooling outlets 116 to canister cooling outlets 54. Again, there are no further air inlets to or outlets from this third air flow path 232. Third air flow path 232 is bounded by canister wall 12, motor housing 118, second barrier 220 and third barrier 154.

In FIG. 3*c*, pump discharge baffle **120*b* extends from a second barrier 220 at edge 234 to a sealing relationship at edge 148 with noise absorbing material 144 adhered to first barrier 76**.

Third air flow path 232 may further comprise first and second out let baffles, 240 and 242, interposed between motor cooling air outlet 116 and canister cooling air outlet 54. First outlet baffle 240 extends from third barrier 154 and projects toward second barrier 220. Second outlet baffle 242 extends from second barrier 220 and projects toward third barrier 154.

Figure 5:
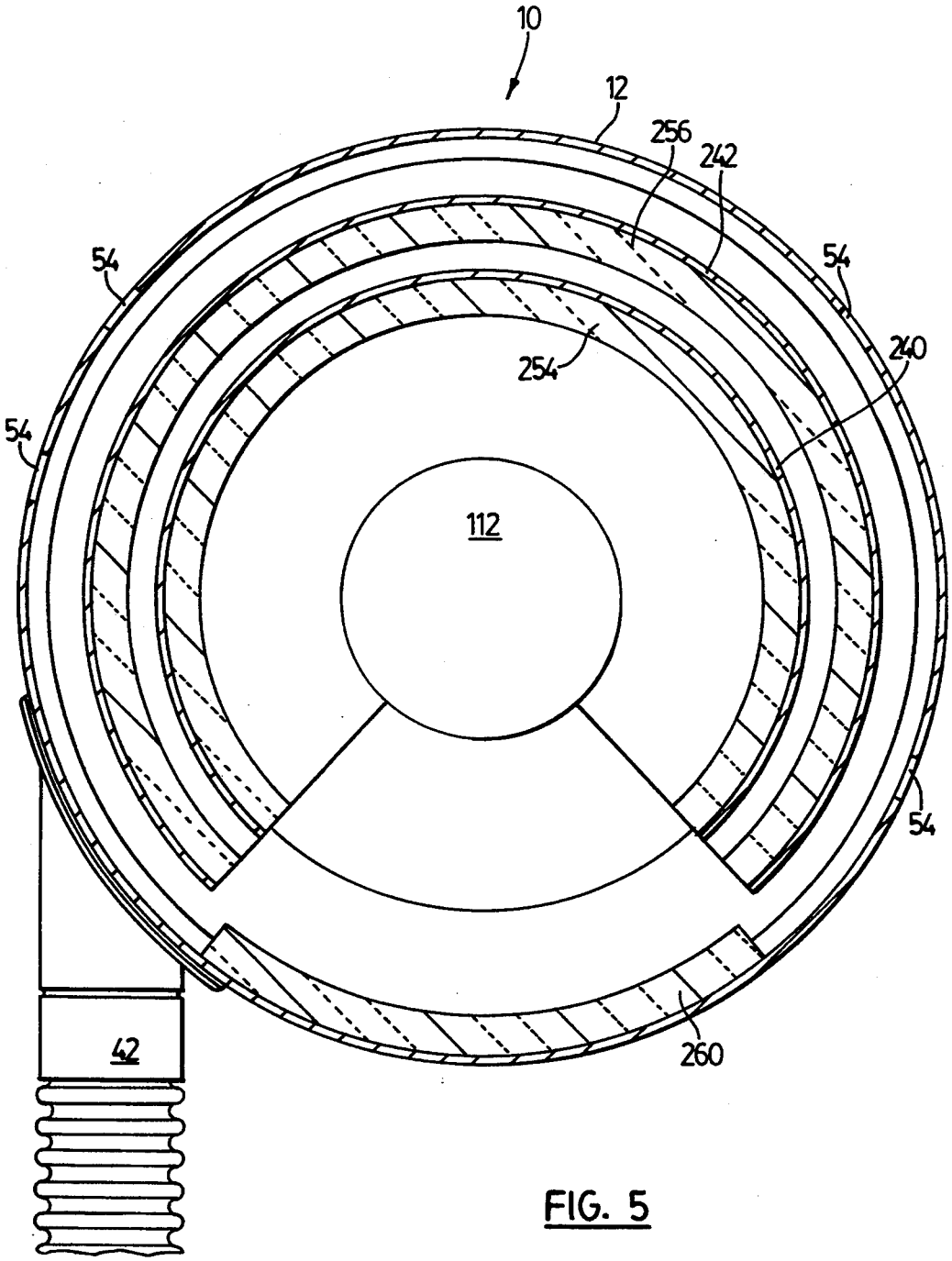
FIG. 5 is a cross-sectional plan view along the line V—V of FIG. 3*c* showing the relationship of the baffles within a third isolated air flow path of an embodiment of the present invention.

As shown in FIG. 5 which is a cross-section along line V—V of FIG. 3*c*, first and second baffles 240 and 242 form concentric arcs about motor 112 in a spaced relationship. As a result of this spaced relationship, as shown in FIG. 3*c*, cooling air flowing in the direction of arrow 244 must follow a tortuous path 246 between first and second outlet baffles 240 and 242 before flowing in the path shown by direction arrow 248. The spacing of baffles 240 and 242 avoids significant resistance to the flow of cooling air from motor cooling air outlets 116 to canister cooling air outlets 54. In an alternate embodiment, only one of the outlet baffles, 240 or 242 may be provided.

The placement of outlet baffles 240 and 242 between electric motor 112 and canister cooling air outlets 54 eliminates any line of sight between motor cooling air outlets 116 and canister cooling air outlets 54; this reduces the noise emanating from electric motor 112 and travelling outside of canister wall 12.

The inner faces 250 and 252 of first and second outlet baffles 240 and 242 are lined with noise absorbent material 254 and 256.

Electrical wiring to supply electric motor 112 (which not shown) is provided through the arcuate gaps in baffles **120*c* (not shown), 240 and 242. The length of the arcuate gaps of the baffles is determined by the space requirements for the electrical components (not shown) for electric motor 112. To compensate for the arcuate gaps, lengths of noise absorbent material 210** (seen in FIG. 3*c*) and 260 are adhered to canister wall 12 adjacent to the arcuate gaps.

Figure 6:
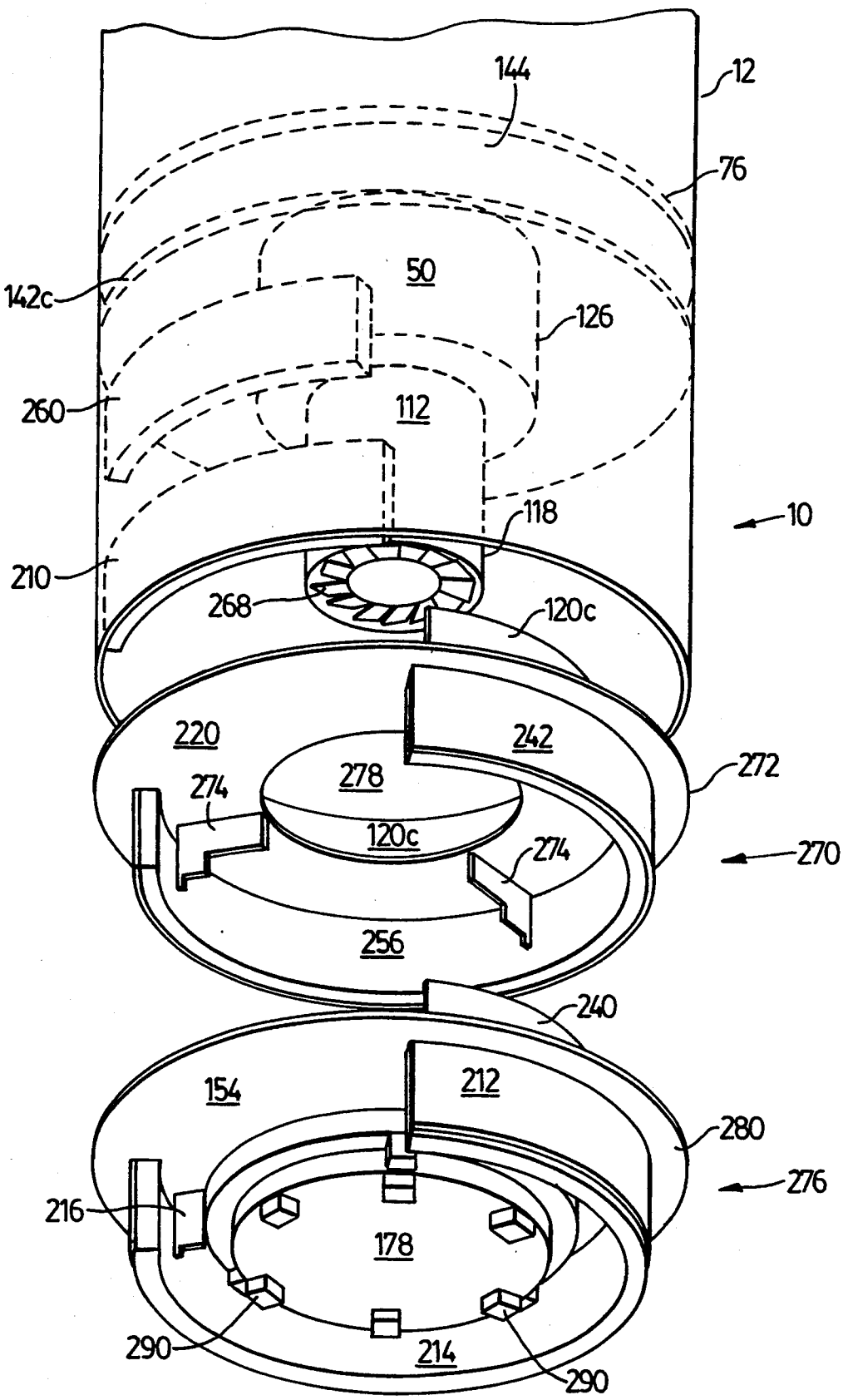
FIG. 6 is an exploded perspective view of the barriers and baffles of the embodiment of the present invention of FIG. 3*c*.

With reference to FIG. 6, the components which may be used to provide the embodiment illustrated in FIG. 3*c* are shown.

Electric motor 112 with air circulating fan 268 is mounted directly to air pump 50. First barrier 76 is integrally formed within canister wall 12. Air pump 50 is directly mounted to barrier 76 the annular layer of noise absorbent material 144 attached to barrier 76 surrounds air pump 50.

Assembly 270, of unitary construction and preferably molded from a resilient, moderately heat resistant PVC material, comprises second barrier 220 (shown as an annular disk 272), from which extend in opposite directions generally perpendicular to the surface of second barrier 220, pump discharge baffle **120*c* and second outlet baffle 242. Several spacer or support means 274 project radially from the centre of annular disk 272 to provide support for second assembly 276 (described below) which is stacked beneath assembly 270**.

Second assembly 276 is also of unitary construction and is in all aspects identical to assembly 270. Second assembly 276 comprises third barrier 154 (shown as annular disk 280), from which extend in opposite directions generally perpendicular to the surface of third barrier 154, first outlet baffle 240 and arcuate barrier 212.

To construct the embodiment of FIG. 3*c*, it is necessary that first outlet baffle 240 and second outlet baffle 242 be of appropriately different radiuses to achieve a concentric nesting relationship past which air may flow without significant resistance.

To assemble canister vacuum cleaner 10, noise absorbent material **142*c*, if desired, may first be adhered inside canister wall 12 around the air pump 50**.

Assembly 270 is then inserted into canister 12 until pump discharge baffle **120*c* is in sealing relationship with noise absorbent material 144** as described with reference to FIG. 3*c*. Annulus 278 of annular disk 272 is also brought into sealing relationship with casing 130 of air pump 50.

A strip of noise absorbent material 260 may be adhered to the inside of canister wall 12 adjacent to the gap in second outlet baffle 242.

The inner surface of second outlet baffle 242 may be lined with noise absorbent material 256.

Although not shown, the inner surface of first outlet baffle 240 may also be lined with noise absorbent material.

Second assembly 276 is then inserted into canister 12 until first outlet baffle 240 rests upon radial spacer or support members 274. The inner surface of barrier 212 may further be lined with noise absorbent making 214. Donut-shaped sealing adaptor 160 (not shown) may be adhered to surface of annular disk 280 on the same side from which first outlet baffle 240 projects. As described with reference to FIG. 3*c*, the adaptor 160 provides a sealing relationship between barrier 154 and the housing 118 of motor 112.

Inlet baffle 178 is then brought into resting relationship with radial spacer or support members 216 which correspond to radial spacer or support members 274 of assembly 270.

Spacers 290 are provided on inlet baffle 178 to prevent any sealing relationship with bottom plate 16 (not shown) when the canister is closed.

Other modification will be apparent to those skilled in the art and, therefore, the invention is defined in the claims.

We claim:

1. Noise dampening apparatus for use in a canister vacuum cleaner of the type having a canister with two closed ends; an air inlet and an air outlet in said canister; a first barrier in said canister between said air inlet and said air outlet, said first barrier having an aperture therethrough, said first barrier defining a sealed first air pathway between a first of said two closed ends of said canister and said first barrier, said first air pathway incorporating said air inlet and said aperture; a cooling air inlet and a cooling air outlet in said canister; an air pump assembly in said canister, said air pump assembly having an air pump and an electric motor, said air pump having a pump inlet and a pump outlet, said air pump assembly mounted to said first barrier with said pump inlet sealed about said aperture and adapted, when driven by said electric motor, to pump air therethrough to said pump outlet, said electric motor having a motor cooling air inlet, a motor cooling air outlet and a fan, said fan drawing air from said motor cooling air inlet to said motor cooling air outlet when said electric motor is actuated;

said noise dampening apparatus comprising, in order of stacked arrangement within said canister vacuum cleaner, a first component, a second component and a cooling air inlet baffle, each of said first and second components being identical and each comprising:

(i) a barrier portion, said barrier portion having a first side and a second side;

(ii) a first baffle extending generally perpendicularly from said first side of said barrier portion;

(iii) a second baffle extending generally perpendicularly from said second side of said barrier portion; and (iv) spacer means on said first side of said barrier portion, said barrier portion of said first component forming a second barrier sealingly engaging said canister between said air outlet and said cooling air outlet and sealingly engaging said pump assembly between said pump outlet and said motor cooling air outlet, thereby defining a sealed second air pathway between said first barrier and said second barrier, said second air pathway incorporating said pump outlet and said air out let;

said barrier portion of said second component forming a third barrier sealingly engaging said canister between said cooling air inlet and said cooling air outlet and sealingly engaging said pump assembly between said motor cooling air inlet and said motor cooling air outlet, thereby defining a sealed third air pathway between said second barrier and said third barrier, said third air pathway incorporating said motor cooling air outlet and said cooling air outlet, said third barrier also thereby defining a sealed fourth air pathway between said third barrier and said other of said two closed ends of said canister, said fourth air pathway incorporating said cooling air inlet and said motor cooling air inlet;

said spacer means of said second component for positioning said cooling air inlet baffle between said motor cooling air inlet and said cooling air inlet, said first baffle of said second component and said cooling air inlet baffle providing, in combination, no line of sight between said motor cooling air inlet and said cooling air inlet;

said spacer means of said first component for positioning said first component in stacked relationship with said second component;

said second baffle of said second component and said first baffle of said first component, in combination, providing no line of sight between said motor cooling air outlet and said cooling air outlet without blocking said third sealed air pathway; and said second baffle of said first component sealingly engaging said first barrier and providing no line of sight between said pump outlet and said air outlet without blocking said second sealed air pathway.

2. The noise dampening apparatus as claimed in claim 1 wherein said air pump comprises a casing, said casing housing an impeller,said impeller having a rotational axis, said casing being generally circular in cross-section perpendicular to the plane of said rotational axis of said impeller, said pump outlet comprising a plurality of outlet openings through said casing circumferentially of said impeller, said outlet openings opening generally tangentially to said circular cross-section in order to direct air flow from said casing through said outlet openings generally tangentially of said circular cross-section, said pump inlet comprising an opening through said casing proximate said rotational axis of said impeller.

3. The noise dampening apparatus as claimed in claim 2 wherein said second baffle of said first component is arcuate about the rotational axis of said impeller, said second baffle forming an arc about a portion of said casing and said pump outlet openings.

4. The noise dampening apparatus as claimed in claim 3 wherein said second baffle of said second component and said first baffle of said first component are arcuate about the rotational axis of said impeller and both form an arc about a portion of said motor.

5. The noise dampening apparatus as claimed in claim 4 wherein said canister is cylindrical in shape and wherein said first, second and third barriers are disc-shaped.

6. Noise dampening apparatus for use in a canister vacuum cleaner of the type having a vertically oriented, cylindrical canister with two closed ends; an air inlet and an air outlet in said canisters a first horizontal barrier in said canister between said air inlet and said air outlet, said first horizontal barrier having an aperture therethrough, said first horizontal barrier defining a sealed first air pathway between a first of said two closed ends of said canister and said first horizontal barrier, said first air pathway incorporating said air inlet and said aperture; a cooling air inlet and a cooling air outlet in said canister; an air pump assembly in said canister, said air pump assembly having an air pump and an electric motor, said air pump having a pump inlet and a pump outlet, said air pump assembly mounted to said first horizontal barrier with said pump inlet sealed about said aperture and adapted, when driven by said electric motor, to pump air therethrough to said pump outlet, said electric motor having a motor cooling air inlet, a motor cooling air outlet and a fan, said fan drawing air from said motor cooling air inlet to said motor cooling air outlet when said electric motor is actuated;

said noise dampening apparatus comprising, in order of stacked arrangement within said canister vacuum cleaner, a first component, a second component and a cooling air inlet baffle, each of said first and second components being identical and each comprising, (i) a horizontal barrier, said horizontal barrier having a lower side and an upper side;

(ii) a downwardly depending baffle depending generally perpendicularly from said lower side of said horizontal barrier;

(iii) a upstanding baffle extending generally perpendicularly from said upper side of said horizontal barrier; and (iv) spacer means on said lower side of said horizontal barrier, said horizontal barrier of said first component forming a second horizontal barrier sealingly engaging said canister between said air outlet and said cooling air outlet and sealingly engaging said pump assembly between said pump outlet and said motor cooling air outlet, thereby defining a sealed second air pathway between said first horizontal barrier and said second horizontal barrier, said second air pathway incorporating said pump outlet and said air outlet;

said horizontal barrier portion of said second component forming a third horizontal barrier sealingly engaging said canister between said cooling air inlet and said cooling air outlet and sealingly engaging said pump assembly between said motor cooling air inlet and said motor cooling air outlet, thereby defining a sealed third air pathway between said second horizontal barrier and said third horizontal barrier, said third air pathway incorporating said motor cooling air outlet and said cooling air outlet, said third horizontal barrier also thereby defining a sealed fourth air pathway between said third horizontal barrier and said other of said two closed ends of said canister, said fourth air pathway incorporating said cooling air inlet and said motor cooling air inlet;

said spacer means of said second component for positioning said cooling air inlet baffle between said motor cooling air inlet and said cooling air inlet, said downwardly depending baffle of said second component and said cooling air inlet baffle providing, in combination, no line of sight between said motor cooling air inlet and said cooling air inlet;

said spacer means of said first component for positioning said first component in stacked relationship with said second component;

said upstanding baffle of said second component and said downwardly depending baffle of said first component, in combination, providing no line of sight between said motor cooling air outlet and said cooling air outlet without blocking said third sealed air pathway; and said upstanding baffle of said first component sealingly engaging said first horizontal barrier and providing no line of sight between said pump outlet and said air outlet without blocking said second sealed air pathway.

7. The noise dampening apparatus as claimed in claim 6 wherein said air pump comprises a casing, said casing housing an impeller, said impeller having a rotational axis, said casing being generally circular in cross-section perpendicular to the plane of said rotational axis of said impeller, said pump outlet comprising a plurality of outlet openings through said casing circumferentially of said impeller, said outlet openings opening generally tangentially to said circular cross-section in order to direct air flow from said casing through said outlet openings generally tangentially of said circular cross-section, said pump inlet comprising an opening through said casing proximate said rotational axis of said impeller.

8. The noise dampening apparatus as claimed in claim 7, wherein said second baffle of said first component is arcuate about the rotational axis of said impeller, said second baffle forming an arc about a portion of said casing and said pump outlet openings.

9. The noise dampening apparatus as claimed in claim 8 wherein said second baffle of said second component and said first baffle of said first component are arcuate about the rotational axis of said impeller and both form an arc about a portion of said motor.

10. The noise dampening apparatus as claimed in claim 9 wherein said canister is cylindrical in shape and wherein said first, second and third horizontal barriers are disc-shaped.

* * * * *

UNITED STATES PATENT AND TRADEMARK OFFICE

CERTIFICATE OF CORRECTION

PATENT NO. : 5,400,463

DATED : March 28, 1995

INVENTOR(S) : Carmel P. Attard et al.

It is certified that error appears in the above-indentified patent and that said Letters Patent is hereby corrected as shown below:

Column 12, line 67, delete "canisters" and insert --canister;--.

Signed and Sealed this

Twentieth Day of June, 1995

*Attest:*

*Attesting Officer*

BRUCE LEHMAN

*Commissioner of Patents and Trademarks*